US007493781B2

(12) United States Patent
Ooe

(10) Patent No.: US 7,493,781 B2
(45) Date of Patent: Feb. 24, 2009

(54) ULTRASONIC WASHING APPARATUS

(75) Inventor: Hirokazu Ooe, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 642 days.

(21) Appl. No.: 10/507,803

(22) PCT Filed: Oct. 2, 2003

(86) PCT No.: PCT/JP03/12692

§ 371 (c)(1),
(2), (4) Date: Sep. 14, 2004

(87) PCT Pub. No.: WO2004/031469

PCT Pub. Date: Apr. 15, 2004

(65) Prior Publication Data

US 2005/0252540 A1 Nov. 17, 2005

(30) Foreign Application Priority Data

Oct. 7, 2002 (JP) ..... 2002-293299

(51) Int. Cl.
*D06F 7/04* (2006.01)

(52) U.S. Cl. ..... 68/3 SS; 134/198; 134/201; 134/184

(58) Field of Classification Search ..... 134/708, 134/184, 198, 201; 68/3 SS
See application file for complete search history.

(56) References Cited

U.S. PATENT DOCUMENTS 5,148,848 A * 9/1992 Murray et al. ..... 160/67
6,493,289 B2 * 12/2002 Kitaori et al. ..... 367/189
2002/0134117 A1 * 9/2002 Arai et al. ..... 68/3 SS
2005/0072194 A1 4/2005 Ryohke et al.

FOREIGN PATENT DOCUMENTS

| | | | |
|---|---|---|---|
| CN | 1271791 A | | 11/2000 |
| JP | 54-32980 | | 3/1979 |
| JP | 57-122889 | | 7/1982 |
| JP | 59-75266 | | 5/1984 |
| JP | U-61-12494 | * | 1/1986 |

(Continued)

OTHER PUBLICATIONS

International Search Report for corresponding PCT/JP03/12692, mailed Jan. 25, 2004.

(Continued)

*Primary Examiner*—Frankie L Stinson
*Assistant Examiner*—Samuel A Waldbaum
(74) *Attorney, Agent, or Firm*—Renner, Otto, Boisselle & Sklar, LLP

(57) ABSTRACT

An ultrasonic washing apparatus, comprising a body part, an ultrasonic vibrating horn exposed to the outside of the body part, a liquid feeding means for feeding liquid to the ultrasonic vibrating horn, and a mounting means for mounting the body part at any position, the mounting means further comprising a support arm to be installed on an installed object such as a full automatic washing machine, wherein the support arm is extendable, energized in a retracting direction by a helical tension spring, and can stop an extension at any length with a fixing screw, and the body part can change an attitude or a position relative to the mounting means.

1 Claim, 8 Drawing Sheets

FOREIGN PATENT DOCUMENTS

| | | |
|---|---|---|
| JP | 63-114286 | 7/1988 |
| JP | 3-103091 | 10/1991 |
| JP | 05-137992 | 6/1993 |
| JP | 61-12494 | 4/1994 |
| JP | 11-057274 | 3/1999 |
| JP | 2000-061192 | 2/2000 |
| JP | 2000-308788 | 11/2000 |
| JP | 2000-317188 | 11/2000 |
| JP | 2001-310094 | 11/2001 |
| JP | 2001-310165 | 11/2001 |
| JP | 2002-191893 | 7/2002 |
| JP | 2002-273092 | 9/2002 |
| WO | 02/075034 | 9/2002 |

OTHER PUBLICATIONS

European Search Report for corresponding Application No. 03753998.8, mailed Nov. 3, 2005. (Previously submitted Dec. 12, 2005).

* cited by examiner

ULTRASONIC WASHING APPARATUS

TECHNICAL FIELD

The present invention relates to an ultrasonic washing apparatus that permits partial washing of textile articles.

BACKGROUND ART

There have conventionally been proposed many apparatuses that achieve washing by exploiting ultrasonic waves. Japanese Patent Applications Laid-Open Nos. 2001-310094 and 2001-310165 disclose handy ultrasonic washing apparatuses. These apparatuses have an ultrasonic horn joined to an ultrasonic vibrator housed in a hand-held casing, and achieve washing with the tip of the ultrasonic horn kept in contact with an article to be cleaned that has been soaked in washing liquid so as to be imbued therewith. The power source is a battery housed in the casing.

These conventional ultrasonic washing apparatuses boast their compactness and light weight, and accordingly produce a rather low output of ultrasonic vibration. Thus, to obtain a satisfactory washing effect, they need to be passed over and over across the article to be cleaned. Compact and lightweight as these apparatuses are, repeating such operation causes fatigue in the user's hand. Moreover, since the user needs to use one hand to hold the ultrasonic washing apparatus, he or she needs to hold the article to be cleaned with the other hand alone. This makes it impossible to hold the article tense, resulting in wrinkles and twists developing therein as the ultrasonic washing apparatus is passed across it. With wrinkles or twists in the article, the ultrasonic horn cannot be kept in optimal contact with the article. This not only hampers obtaining the expected washing effect, but also tends to result in the article being cleaned unevenly or imperfectly in wrinkled or twisted parts thereof.

DISCLOSURE OF THE INVENTION

An object of the present invention is to provide an ultrasonic washing apparatus which offers a high ultrasonic vibration output combined with a versatility that makes it usable at any place and which allows effective washing in so short a time as not to cause the user to feel fatigue.

To achieve the above object, according to the present invention, an ultrasonic washing apparatus is provided with a main unit, an ultrasonic vibration horn exposed out of the main unit, a liquid feeder for feeding liquid to the ultrasonic vibration horn, and an fitter for permitting the main unit to be fitted at a desired place. With this construction, the ultrasonic washing apparatus can be fitted at a desired place when used, and the user does not need to take it into consideration to hold it with the hand when performing washing. Thus, lightweightedness is no longer an essential factor. Accordingly, the ultrasonic washing apparatus can be fitted not with a compact, lightweight, thus low-output ultrasonic vibrator unit but a large, high-output one. This makes it possible to transmit an ultrasonic wave with a high energy level over a wide area, and thus to perform effective washing in a short time. Since the user does not need to support the weight of the ultrasonic washing apparatus, he or she feels less fatigue. Moreover, since the user can use both hands, he or she can hold an article to be cleaned sufficiently tense so as not to develop wrinkles or twists. This makes it possible to adjust how the article is pressed against the ultrasound vibration horn so that they are kept in optimal contact with each other, and thereby to make the most of the washing ability of the ultrasonic washing apparatus. Moreover, since the ultrasonic vibration horn is provided with the liquid feeder that feeds it with liquid, it is possible to perform washing while keeping the spot to be cleaned optimally wet. This eliminates the need to dampen the article to be cleaned as a whole beforehand by soaking it in the liquid.

According to the present invention, the main unit or the fitter is fitted with a drive circuit for making the ultrasonic vibration horn produce ultrasonic vibration. With this construction, the drive circuit and the main unit or the fitter can be built into a single unit, leading to a compact construction and a consolidated design as a whole.

According to the present invention, the fitter has an fitting portion that exploits an attraction force. This construction makes the fitting of the ultrasonic washing apparatus easy. It is also easy to remove the ultrasonic washing apparatus and fix it at another place. This permits the ultrasonic washing apparatus to be used at different places, and thus enhances its usability.

According to the present invention, the fitter includes at least one bar-shaped or plate-shaped- support arm having an fitting portion provided at an end or in any other portion thereof. With this construction, the ultrasonic washing apparatus can easily be fitted to a target object with a comparatively long fitting span, such as a washing machine or kitchen sink. The ultrasonic washing apparatus can be fitted stably, as if a man stretching his legs to stand firm.

According to the present invention, the support arm is telescopic. With this construction, the support arm can be adjusted to a length that suits the target object. This helps widen the choice of places at which the ultrasonic washing apparatus can be fitted.

According to the present invention, the support arm is biased by a spring in the direction of the telescopic displacement thereof. With this construction, without adjusting the support arm precisely to the length of the target object, simply by putting the fitting portions at both ends of the support arm on the target object, the support arm can be fixed to the target object by the force of the spring. This permits easy and quick fitting of the ultrasonic washing apparatus.

According to the present invention, the support arm can be locked in a state telescopically displaced to a desired length. With this construction, the telescopic displacement of the support arm can be locked at a desired length, and thus the support arm can be fixed firmly so as not to get loose from the target object.

According to the present invention, outside the support arm is fitted a slidable fitting portion. With this construction, the position of the fitting portion can be adjusted to suit the size of the target object. This helps widen the choice of places at which the ultrasonic washing apparatus can be fitted.

According to the present invention, the slidable fitting portion is biased by a spring in a direction in which the slidable fitting portion can slide. With this construction, without adjusting the position of the fitting portion precisely to suit the size of the target object, simply by putting the fitting portion on the target object, the support arm can be fixed to the target object by the force of the spring. This permits easy and quick fitting of the ultrasonic washing apparatus.

According to the present invention, the slidable fitting portion can be locked in a desired position. With this construction, the sliding of the fitting portion can be locked in a desired position, and thus the support arm can be fixed firmly so as not to get loose from the target object.

According to the present invention, the posture of the main unit relative to the fitter can be changed. With this construction, the posture of the main unit can be adjusted so that the user can perform washing in a comfortable posture. When the ultrasonic washing apparatus is not used, it can be retracted into an unobtrusive posture, i.e., into a retracted posture.

According to the present invention, in the ultrasonic washing apparatus as described above, there is provided a lock for inhibiting change of the posture of the main unit. With this construction, when the main unit needs to be kept in a particular posture as during washing or when retracted, it can be locked in that position so as to remain steady. This permits washing to be performed steadily during washing, and prevents the main unit from moving unexpectedly and hitting another object when retracted.

According to the present invention, the position of the main unit relative to the fitter can be changed. With this construction, the position of the main unit can be adjusted so that the user can perform washing in a convenient position. When the ultrasonic washing apparatus is not used, it can be retracted into an unobtrusive position, i.e., into a retracted position.

According to the present invention, the main unit is removable from the fitter. With this construction, whenever necessary, the main unit can be removed from the fitter so that the user can perform washing while holding it with the hand. This makes it possible to freely set the relative position between the washing apparatus and the article to be cleaned, and thus helps further widen the application of the washing apparatus.

According to the present invention, in the ultrasonic washing apparatus as described above, there is provided a water receiving portion for feeding water simultaneously to the liquid feeder and elsewhere. With this construction, in a case where there is another appliance or a place that requires water, it is possible to operate the ultrasonic washing apparatus while feeding water also to that appliance or place. This makes it possible to share a single faucet, for example, with a washing machine.

According to the present invention, in the ultrasonic washing apparatus as described above, the main unit is combined with a tray for collecting the liquid fed by the liquid feeder. With this construction, the liquid used in washing can be collected in the tray for disposal. This makes it possible to use the ultrasonic washing apparatus even at a place where the liquid cannot be discharged on the spot.

BEST MODE FOR CARRYING OUT THE INVENTION

Hereinafter, embodiments of the present invention will be described with reference to FIGS. 1 to 10.

Figure 1:
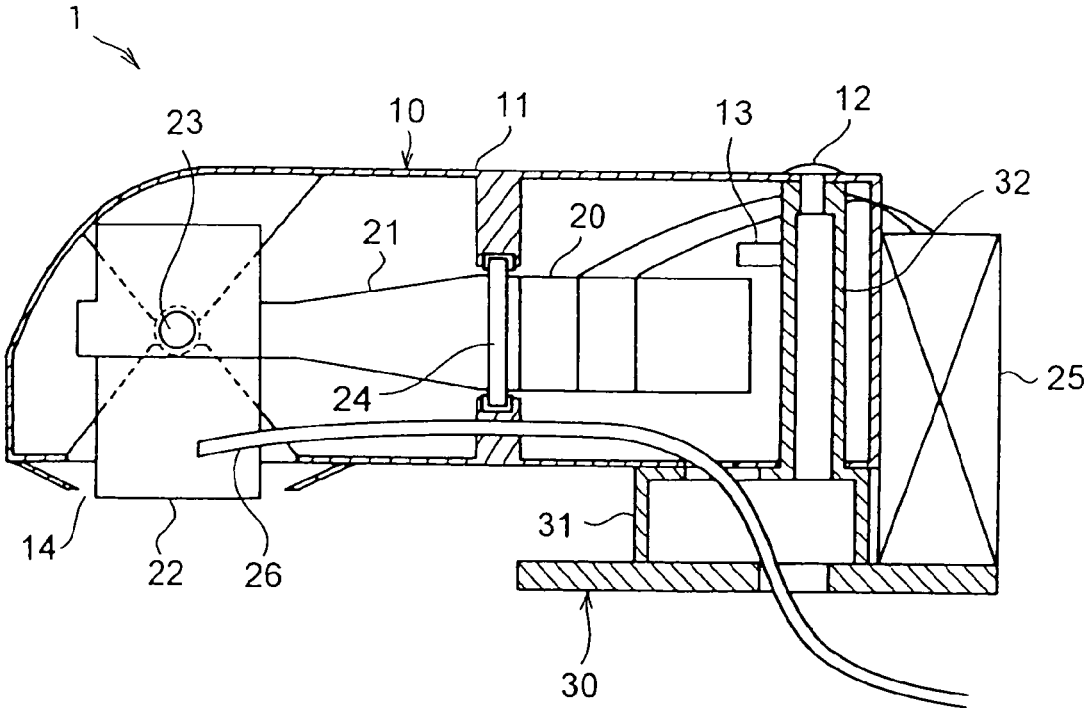
FIG. 1 is a vertical sectional view of the main unit of an ultrasonic washing apparatus.
Figure 2:
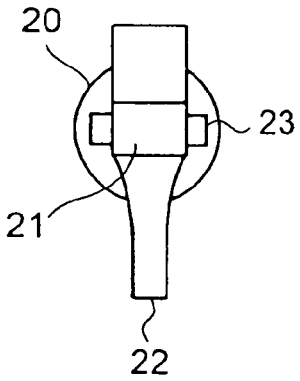
FIG. 2 is a front view of the ultrasonic vibration horn shown in FIG. 1.

FIG. 1 shows a vertical section of a main unit 10 of an ultrasonic washing apparatus 1, and FIG. 2 shows the front appearance of an ultrasonic vibration horn 21. The main unit 10 is combined with an fitter 30 and other elements as shown in FIGS. 5 to 10 to build various embodiments.

The main unit 10 has a casing 11 made of synthetic resin. The casing 11 has the shape of a horizontally extending arm, of which one end serves as a root portion thereof. This portion is coupled to a base 31 made of synthetic resin. The base 31 forms part of an fitter 30. The fitter 30 permits the main unit 10 to be fitted to a desired place. Throughout the present specification, "a desired place" denotes "any of the places where the fitter is usable." That is, the expression does not mean any place without any restrictions or requirements at all. Specifically how the fitter 30 is shaped and structured will be described later with reference to FIGS. 5 to 10.

A vertical stud shaft 32 stands on the base 31, and the stud shaft 32 supports the main unit 10 in such a way that it can rotate in a horizontal plane. An anchor screw 12 is screwed into the stud shaft 32 to prevent the main unit 10 from dropping therefrom. The main unit 10 is provided with a lock 13 that engages with the stud shaft 32. When the lock 32 is acting, it inhibits the rotation of the main unit 10. The lock 13 is pressed against the stud shaft 32 by an unillustrated spring. The lock 32 unlocks when a force stronger than a predetermined level is applied to the main unit 10. Thus, the main unit 10 can be rotated by applying a force stronger than a predetermined level from outside. The lock 13 may be so structured that it can be operated from outside to unlock.

Inside the casing 11, there are arranged an ultrasonic vibrator 20 and an ultrasonic vibration horn 21 joined thereto. The ultrasonic vibration horn 21 has substantially the shape of the letter T brought down sideways, and a head portion 22 thereof, located at one end thereof, is partially exposed through an opening 14 formed in the bottom face of the casing 11. Projections 23 are formed so as to protrude from both side faces of the head portion 22. The projections 23 are formed at a zero-vibration point, i.e., a node point of vibration transmission. These projections 23, together with a flange portion 24 of the ultrasonic vibration horn 21, serve to support the ultrasonic vibrator 20 and the ultrasonic vibration horn 21.

A drive circuit 25 for driving the ultrasonic vibrator 20 is fitted on the outside of the casing 11. An unillustrated power cable runs out of the drive circuit 25 and is connected to commercially distributed electric power.

The drive circuit 25 may be housed inside the casing 11. Alternatively, the drive circuit 25 may be housed inside the fitter 30. This permits the drive circuit 25 and the main unit 10 or the fitter 30 to be built into a single unit, and thus helps achieve a compact construction and a consolidated design as a whole.

The head portion 22 of the ultrasonic vibration horn 21 is provided with a liquid feeder 26. The liquid feeder 26 is realized with a tube that runs out of the base 31 through 11 to a side of the head portion 22. The liquid feeder 26 is connected to an unillustrated tap water faucet, washing liquid tank, or the like.

The wiring between the drive circuit 25 and the ultrasonic vibrator 20 and the piping for the liquid feeder 26 are laid in such a way as not to hamper the rotation of the main unit 10.

Next, how the ultrasonic washing apparatus 1 is used will be described. A force stronger than a predetermined level is applied to the main unit 10 to unlock it. When the posture of the main unit 10 is changed up to the angle at which to perform washing, the lock 13 locks again to inhibit the rotation of the main unit 10. After these preparations, electric power starts to be supplied to the drive circuit 25 to start ultrasonic washing. Water starts to be supplied to the liquid feeder 26 to perform ultrasonic washing while making the article to be cleaned damp with a predetermined amount of water.

The user holds the article to be cleaned with both hands, and presses it against the head portion 22 while holding it tense so as not to develop wrinkles or twists. In this state, as the article is moved slowly, the ultrasonic energy causes cavitation in the damp portion of the article and thereby removes dirt therefrom. The amount of liquid fed from the liquid feeder 26 is so set as to make the washing spot optimally damp. The main unit 10 is locked by the lock 13, and thus remains in position even as the article is moved. This permits washing to be performed steadily.

When the article has been cleaned satisfactorily, the supply of water to the liquid feeder 26 and the supply of electric power to the drive circuit 25 are stopped to finish washing. A force stronger than a predetermined level is applied to the main unit 10 to unlock it, and the posture of the main unit 10 is changed up to the angle into which to retract it. The lock 13 then locks again to inhibit the rotation of the main unit 10. This prevents the main unit 10 in the retracted state from moving unexpectedly and hitting another object.

Figure 3:
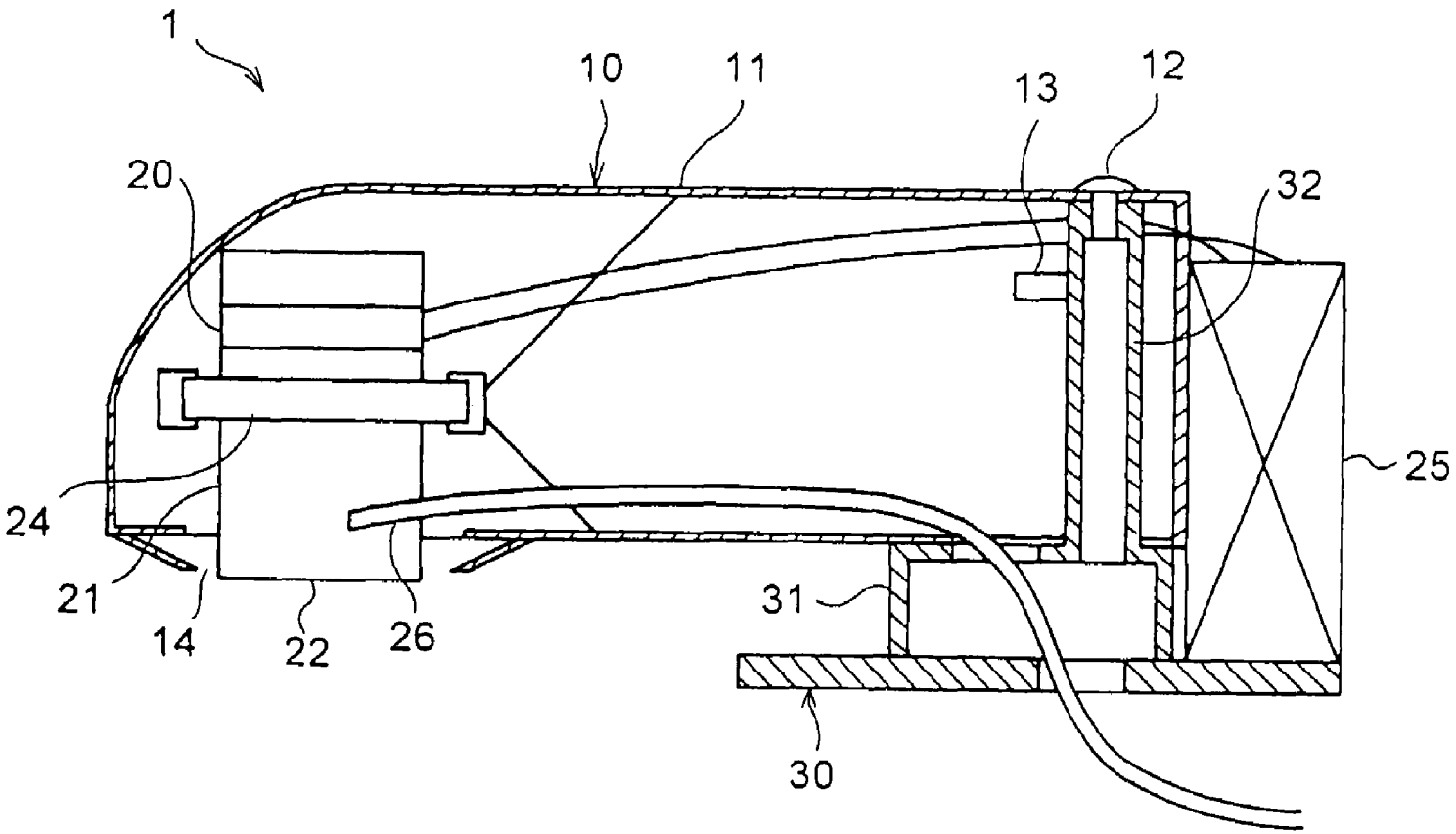
FIG. 3 is a vertical sectional view of a modified example of the main unit of an ultrasonic washing apparatus.
Figure 4:
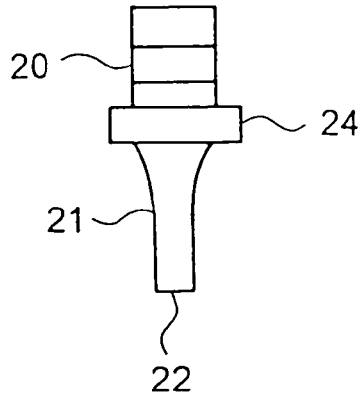
FIG. 4 is a front view of the ultrasonic vibration horn shown in FIG. 3.

FIGS. 3 and 4 show a modified example of the ultrasonic washing apparatus 1. FIG. 3 shows a vertical section of the main unit 10 of the ultrasonic washing apparatus 1, and FIG. 4 shows the front appearance of the ultrasonic vibration horn 21.

In the ultrasonic washing apparatus 1 shown in FIG. 3, the ultrasonic vibration horn 21 is of the straight transmission type. That is, the ultrasonic vibrator 20 is provided right above the ultrasonic vibration horn 21 so that the ultrasonic vibrator 20 makes the ultrasonic vibration horn 21 vibrate just in the same manner as does the ultrasonic vibrator 20 itself. The ultrasonic vibration horn 21 and the ultrasonic vibrator 20 are supported by the flange portion 24 of the ultrasonic vibration horn 21.

Now, how the main unit 10 described above is combined with the fitter 30 and other elements to build various embodiments of the ultrasonic washing apparatus 1 will be described.

Figure 5:
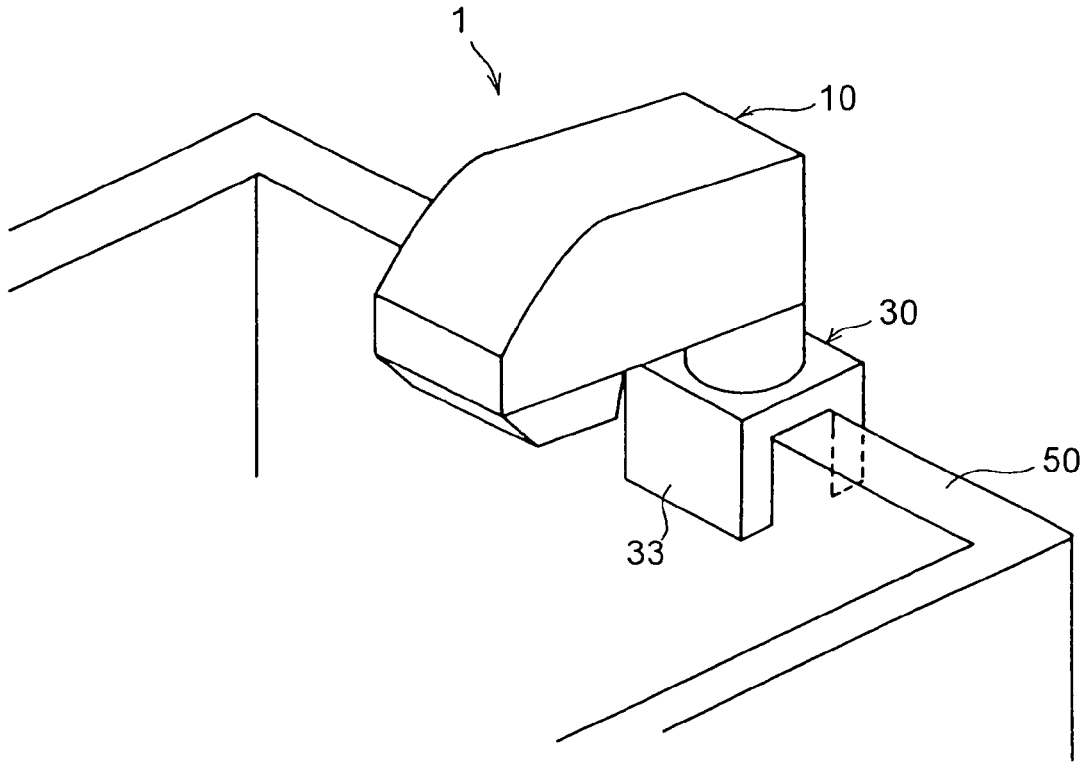
FIG. 5 is a perspective view of the ultrasonic washing apparatus of a first embodiment of the invention.

FIG. 5 shows, in a perspective view, the ultrasonic washing apparatus 1 of a first embodiment of the invention. In this embodiment, the fitter 30 has an fitting portion 33 with a C-shaped sectional shape. The fitting portion 33 is so designed as to mount snugly on the rim of a kitchen sink 50. Simply mounting the fitting portion 33 on the rim of the sink 50 permits the ultrasonic washing apparatus 1 to be fitted in position. The fitting portion 33 may be provided with a screw so that it can be fixed by being tightened with the screw. The fitting portion 33 may be fixed more firmly by being bonded with glue or adhesive tape.

Figure 6:
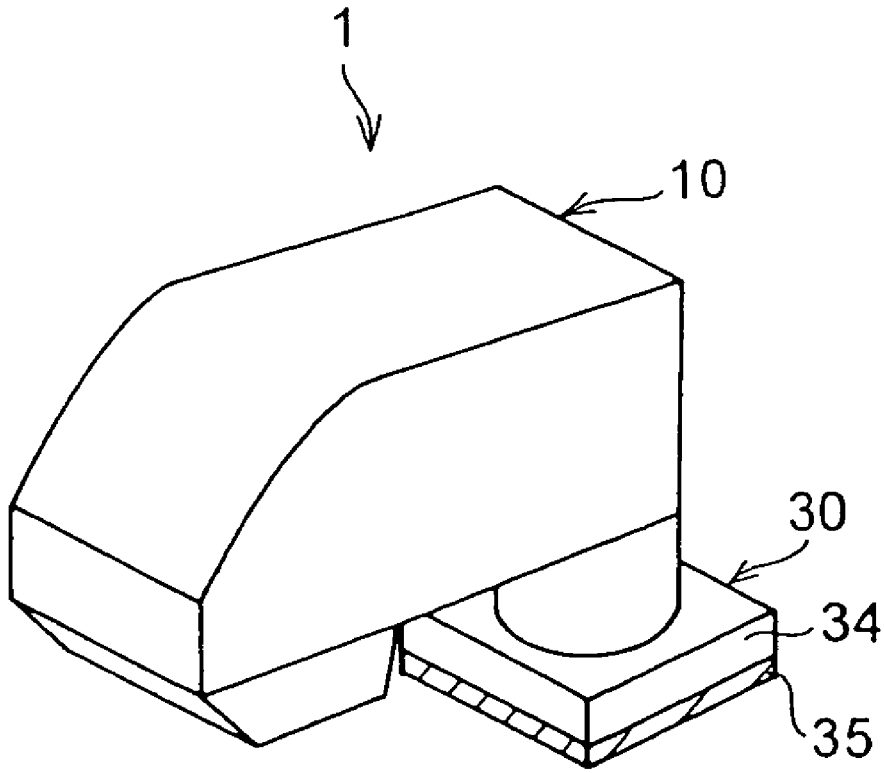
FIG. 6 is a perspective view of the ultrasonic washing apparatus of a second embodiment of the invention.

FIG. 6 shows, in a perspective view, the ultrasonic washing apparatus 1 of a second embodiment of the invention. In this embodiment, the fitter 30 has an fitting portion 34 shaped like a flat plate. A sticker 35 is provided on the bottom face of the fitting portion 34. The sticker 35 is realized with a permanent magnet. Thus, the magnetic attractive force of the sticker 35 permits the fitter 30 to be fitted to a target object so long as it is made of a magnetic metal such as iron.

In a case where the sticker 35 is realized with a permanent magnet, the bottom face of the fitting portion 34 may be entirely covered with a single large piece of magnet, or may be strewn with a plurality of small pieces of magnet.

Advisably, the permanent magnet is so arranged that its height relative to the fitting portion 34 is variable so that, through operation of a lever or the like, the permanent magnet can be moved closer to or away from the target object. With this arrangement, when the permanent magnet is moved closer to the target object, a strong attractive force acts to permit the fitting portion 34 to be fixed firmly; when the permanent magnet is moved away from the target object, the attractive force weakens to permit the fitting portion 34 removed easily. This further enhances the usability.

The sticker 35 may be realized with a sucker so that the fitting portion 34 can be fixed to a flat surface of any material. As the sucker, it is possible to use one or two large suckers, or a large number of small suckers. It is also possible to permit switching of the state of the sucker, between a sucking and a non-sucking state, by permitting the shape thereof to be changed through operation of a lever or the like.

The sticker 35 may be realized with an adhesive substance (such as is used in glued paper tags for clerical use) that permits repeated fitting and removal.

Figure 7:
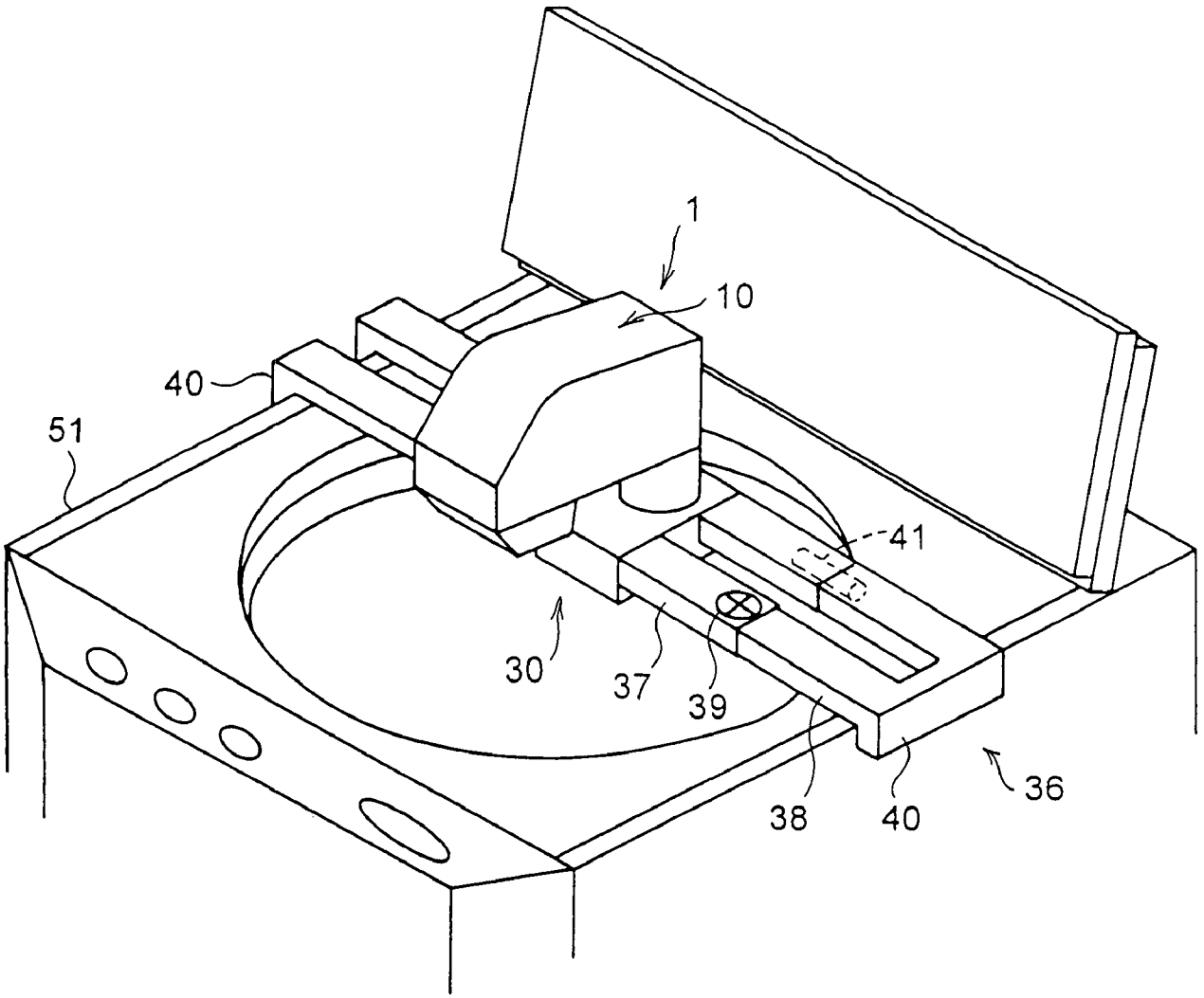
FIG. 7 is a perspective view of the ultrasonic washing apparatus of a third embodiment of the invention.

FIG. 7 shows, in a perspective view, the ultrasonic washing apparatus 1 of a third embodiment of the invention. In this embodiment, the fitter 30 includes a bar-shaped or plate-shaped support arm 36. There may be provided one or more of the support arm 36. The support arm 36 is made so long as to cover the width of full-automatic and two-tub washing machines available on the market.

The support arm 36 is composed of two parallel arm portions coupled together, and is so structured that it can be telescopically displaced. Specifically, in each arm portion, an inner arm 38 is slidably placed inside an outer arm 37. A lock screw 39 for pressing the front-side inner arm 38 is screwed into the front-side outer arm 37 so that, by tightening the lock screw 39, the telescopic displacement of the support arm 36 can be locked at a desired length. Here, "a desired length" denotes any length within the stroke of the displacement of the support arm 36.

At the ends of the outer and inner arms 37 and 38, there are provided fitting portions 40. The fitting portions 40 are shaped like a downward bent hook. Putting across the top face of a full-automatic washing machine 51 the support arm 36 in its telescopically lengthened state with the lock screw 39 loosened, then telescopically shortening the support arm 36 until the fitting portions 40 at both ends firmly grip the full-automatic washing machine 51, and then tightening the lock screw 39 to lock the telescopic displacement of the support arm 36 permits the ultrasonic washing apparatus 1 to be fitted in position. This makes it possible to firmly fix the fitter 30 so that it does not get loose from the full-automatic washing machine 51.

A spring may be inserted between the outer and inner arms 37 and 38 so that the support arm 36 is biased by the spring in the direction of telescopic displacement. For example, the outer and inner arms 37 and 38 are coupled together with a tension coil spring 41 so that the support arm 36 is biased thereby in the direction in which it is telescopically shortened. With this construction, after putting across the top face of the full-automatic washing machine 51 the support arm 36 in its state telescopically lengthened against the force exerted by the spring, simply letting it go causes the fitting portions 40 to automatically grip the full-automatic washing machine 51, and thus permits the ultrasonic washing apparatus 1 to be fitted in position.

The lock screw 39 may be used together. Specifically, after the fitting portions 40 grip the full-automatic washing machine 51, the lock screw 39 is tightened to lock the telescopic displacement of the support arm 36. This permits the ultrasonic washing apparatus 1 to be fitted even more firmly.

Instead of the tension coil spring 41, a compression coil spring may be inserted so that the support arm 36 acts like a contractible rod.

It is possible to set the range of the telescopic displacement of the support arm 36 to cover not only full-automatic and two-tub washing machines but also kitchen sinks.

Figure 8:
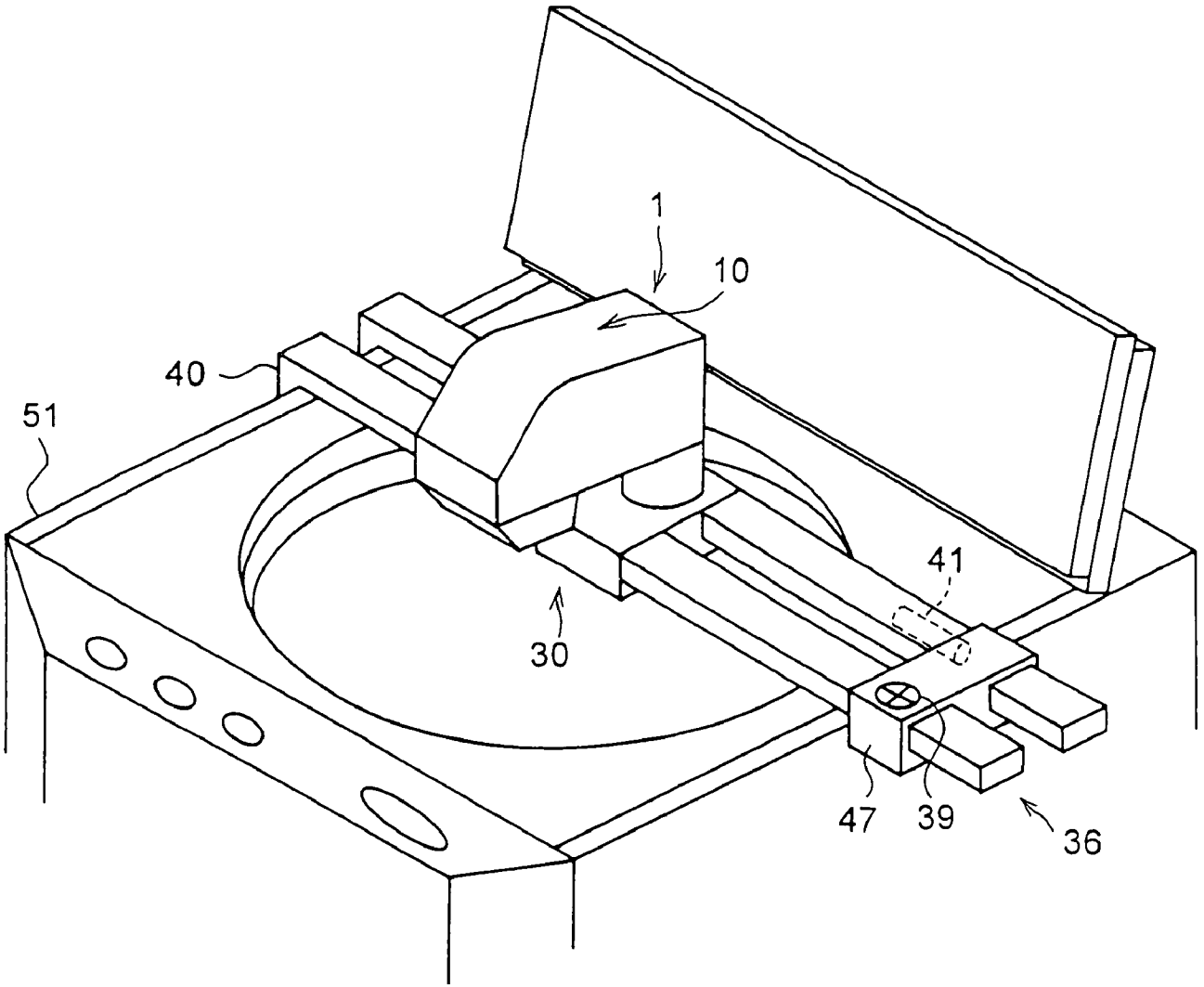
FIG. 8 is a perspective view of the ultrasonic washing apparatus of a fourth embodiment of the invention.

FIG. 8 shows, in a perspective view, the ultrasonic washing apparatus 1 of a fourth embodiment of the invention. This embodiment is a modified version of the third embodiment. Specifically, the lock screw 30 includes a support arm 36 composed of two parallel arm portions coupled together, but this support arm 36 is not telescopic but instead has a slider-type fitting portion 47 at one end.

At the other end of the support arm 36, there is provided a fitting portion 40, which is, as in the third embodiment, shaped like a downward bent hook.

A lock screw 39 for pressing the support arm 36 is screwed into the fitting portion 47 so that, by tightening this lock screw 39, the fitting portion 47 can be locked at a desired position on he support arm 36.

With the lock screw 39 loosened, the fitting portion 47 is slid to the end of the support arm 36, and then the support arm 36 in this state is put across the top face of a full-automatic washing machine 51. Then the fitting portion 47 is slid to a position where it together with the fitting portions 40 firmly grips the full-automatic washing machine 51, and then the lock screw 39 is tightened to lock the sliding of the fitting portion 47. This permits the ultrasonic washing apparatus 1 to be fitted in position. This makes it possible to firmly fix the fitter 30 so that it does not get loose from the full-automatic washing machine 51.

A spring may be inserted between the support arm 36 and the fitting portion 47 so that the fitting portion 47 is biased by the spring toward the middle of the support arm 36 (the portion thereof where the main unit 10 is located) or in the direction opposite thereto. For example, the support arm 36 and the fitting portion 47 are coupled together with a tension coil spring 41 so that the fitting portion 47 is biased thereby toward the middle of the support arm 36. With this construction, after putting across the top face of the full-automatic washing machine 51 the support arm 36 with the fitting portion 47 slid against the force exerted by the spring, simply letting it go causes the fitting portions 40 and 47 to automatically grip the full-automatic washing machine 51, and thus permits the ultrasonic washing apparatus 1 to be fitted in position.

The lock screw 39 may be used together. Specifically, after the fitting portions 40 and 47 grip the full-automatic washing machine 51, the lock screw 39 is tightened to lock the sliding of the fitting portion 47. This permits the ultrasonic washing apparatus 1 to be fitted even more firmly.

Instead of the tension coil spring 41, a compression coil spring may be inserted so that the fitting portion 47 is biased thereby outward.

It is possible to set the slide range of the fitting portion 47 to cover not only full-automatic and two-tub washing machines but also kitchen sinks.

The posture of the main unit 10 relative to the fitter 30 can be changed. When the ultrasonic washing apparatus 1 is fitted to a kitchen sink 50 as shown in FIG. 5, the main unit 10 can be rotated to an angle at which it does not hamper the washing of dishes or hand washing of laundry. When the ultrasonic washing apparatus 1 is fitted to a full-automatic washing machine 51 as shown in FIGS. 7 and 8, the main unit 10 can be rotated to an angle at which it does not hamper the passage of laundry into and out of the full-automatic washing machine 51.

In a case where the fitter 30 is long as in the third and fourth embodiments, the main unit 10 may additionally be so structured as to be movable relative to the fitter 30.

Specifically, in the cases shown in FIGS. 7 and 8, the position of the main unit 10 relative to the support arm 36 (in FIG. 7, relative to the outer arm 37 of the support arm 36) can be changed. This permits the position of the main unit 10 to be changed so that washing can be performed with the main unit 10 placed in a convenient position. When not in use, the main unit 10 can be retracted into an unobtrusive position, i.e., a retracted position.

In all of the first to fourth embodiments, the main unit 10 is removable from the fitter 30. With the anchor screw 12 unscrewed, the main unit 10 can be removed from the stud shaft 32, and can be carried to a place away from the fitter 30 so that washing can be performed with the main unit 10 held with the hand. A coupler of another type than the anchor screw 12 may be used to make the fitting and removal of the main unit 10 easier.

By coupling the main unit 10 and the fitter 30 together by a coupling tube or the like, it is possible to maintain the supply of electric power and water from the fitter 30 to the main unit 10 even when the main unit 10 is removed from the fitter 30. Alternatively, the main unit 10 may be provided with a rechargeable power source and a water tank so as to operate on a cordless basis.

Figure 9:
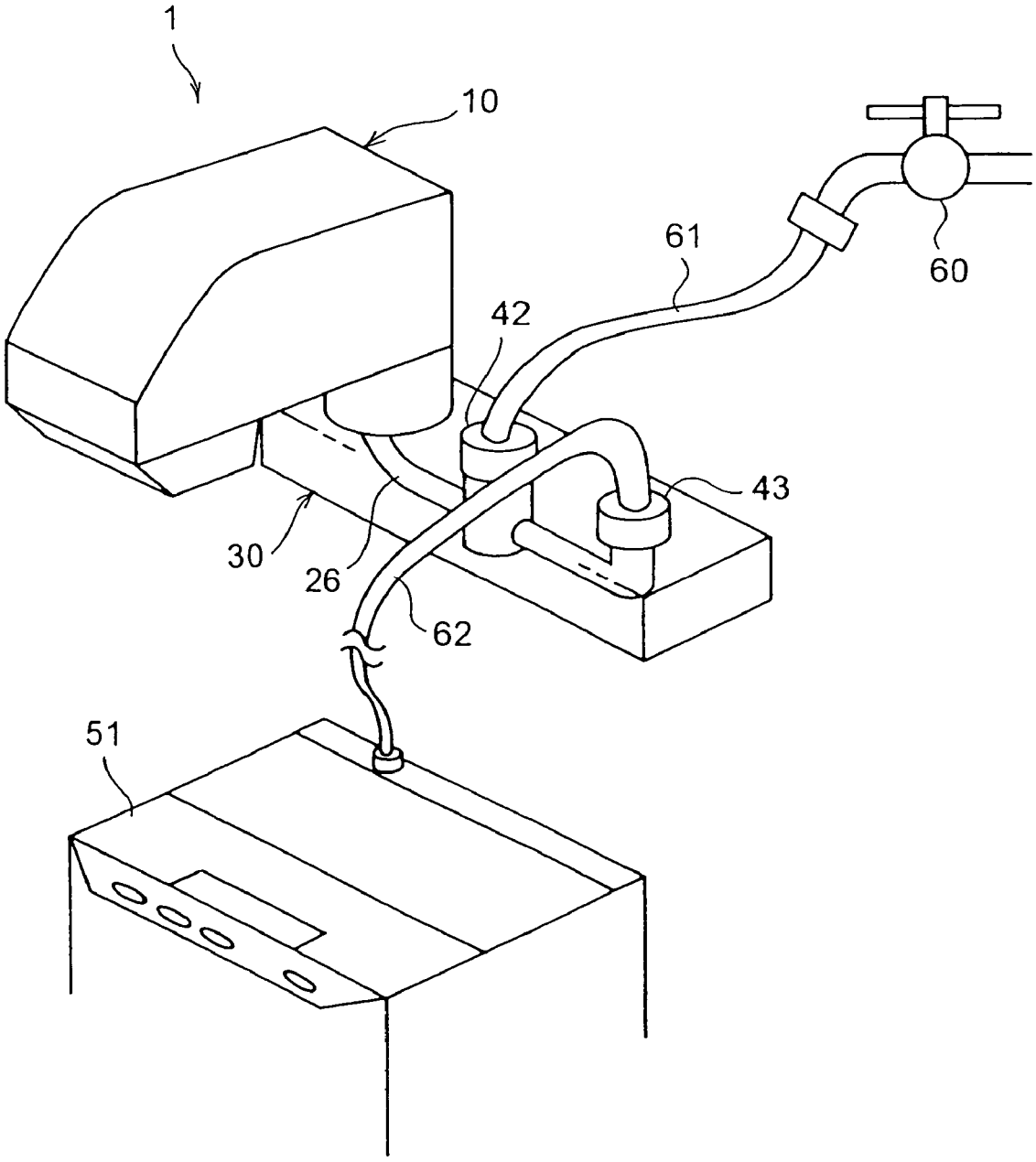
FIG. 9 is a perspective view of the ultrasonic washing apparatus of a fifth embodiment of the invention.

FIG. 9 shows, in a perspective view, the ultrasonic washing apparatus 1 of a fifth embodiment of the invention. In this embodiment, the fitter 30 (of any of the first to fourth embodiments) is additionally provided with a water receiving portion 42. The water receiving portion 42 is connected to a tap water faucet 60 by way of a hose 61, and feeds water simultaneously to the liquid feeder 26 and to a connection port 43 provided by the side of the water receiving portion 42.

By connecting the connection port 43 to a full-automatic washing machine 51 by a hose 62, even if there is only one faucet 60, it is possible to use the ultrasonic washing apparatus 1 and the full-automatic washing machine 51 simultaneously. By providing more connection ports 43, it is possible to feed water to a larger number of appliances or places.

Figure 10:
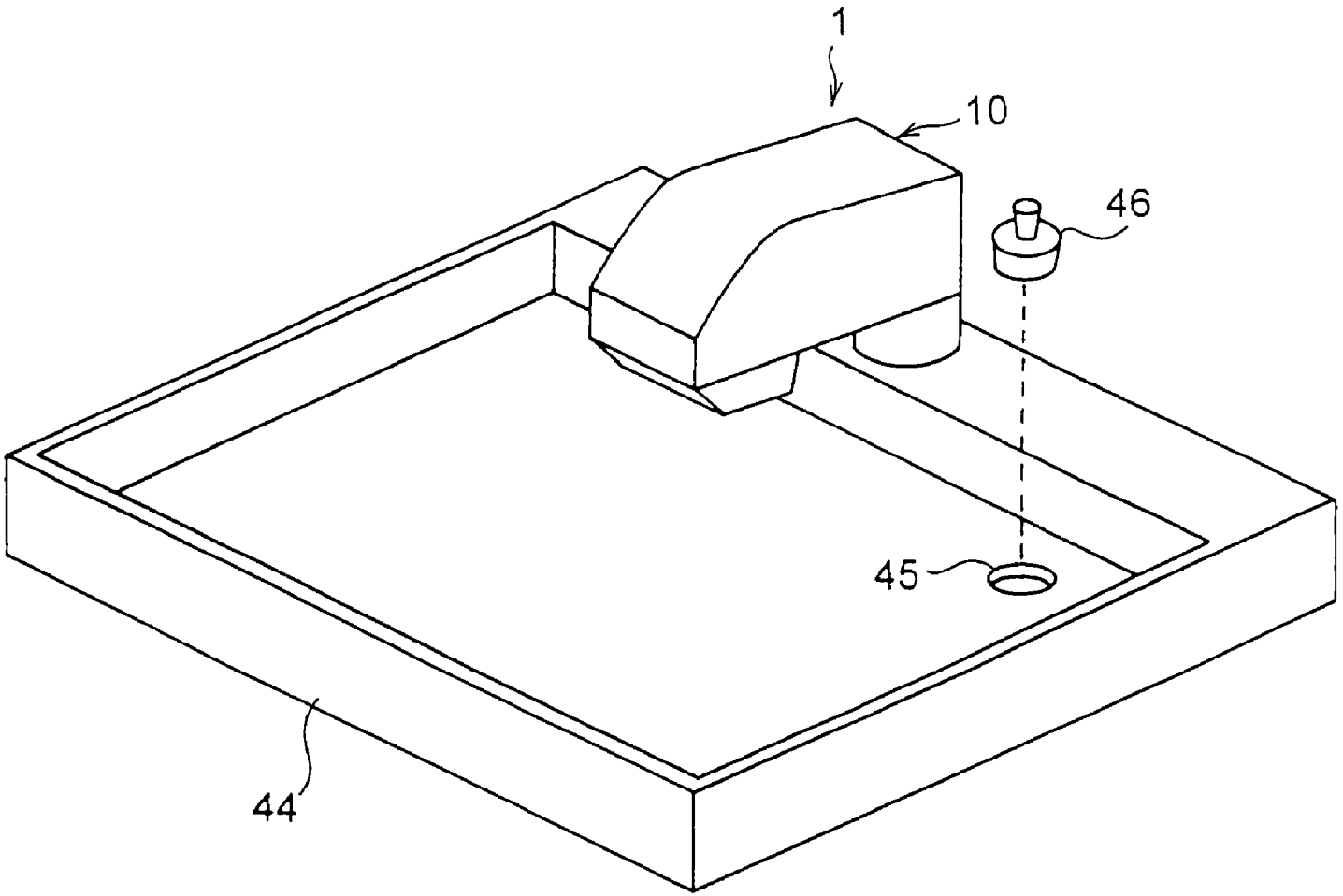
FIG. 10 is a perspective view of the ultrasonic washing apparatus of a sixth embodiment of the invention.

FIG. 10 shows, in a perspective view, the ultrasonic washing apparatus 1 of a sixth embodiment of the invention. In this embodiment, the main unit 10 is combined with a tray 44. The tray 44 has a drain port 45 formed at one place in the bottom face thereof, and the drain port 45 is plugged with a plug 46.

The liquid fed from the liquid feeder 26 is collected in the tray 44. This makes it possible to use the ultrasonic washing apparatus 1 even at a place where the liquid cannot be discharged on the spot. On completion of washing, the ultrasonic washing apparatus 1 is carried to a place where the liquid can be discharged, and then the plug 46 is pulled off to complete the disposal of waste liquid. Making the tray 44 removable from the main unit 10 makes the disposal of waste liquid easier.

It is to be understood that the present invention is not limited in any way by the embodiments thereof described above, because those embodiments are merely examples of how the invention can be implemented. That is, many modifications and variations are possible without the claimed scope of the invention.

INDUSTRIAL APPLICABILITY

The present invention finds wide application in households and businesses as a simple and convenient washing apparatus for washing textile articles.

The invention claimed is:

1. An ultrasonic washing apparatus that can be used independently comprising:

a main unit, an ultrasonic vibration horn exposed out of the main unit, a liquid feeder for feeding liquid to the ultrasonic vibration horn, a drive circuit for driving the ultrasonic vibration horn to produce ultrasonic vibration, and a fitter for permitting the main unit to be fitted at a desired place, wherein the drive circuit is included within at least one of the main unit and the fitter, main unit is combined with a tray for collecting the liquid fed by the liquid feeder, and the main unit combined with the tray is portable such that the main unit combined with the tray may be carried to a place where the liquid can be discharged.

* * * * *